US008985956B2

(12) United States Patent
Hogberg

(10) Patent No.: US 8,985,956 B2
(45) Date of Patent: Mar. 24, 2015

(54) COMPRESSIVE STRESS SYSTEM FOR A GAS TURBINE ENGINE

(75) Inventor: Nicholas Alvin Hogberg, Greenville, SC (US)

(73) Assignee: General Electric Company, Schenectady, NY (US)

( * ) Notice: Subject to any disclaimer, the term of this patent is extended or adjusted under 35 U.S.C. 154(b) by 856 days.

(21) Appl. No.: 13/235,566

(22) Filed: Sep. 19, 2011

(65) Prior Publication Data

US 2013/0071248 A1 Mar. 21, 2013

(51) Int. Cl.

| | |
|---|---|
| ***F01D 5/22*** | (2006.01) |
| ***F01D 5/30*** | (2006.01) |
| ***F01D 5/28*** | (2006.01) |

(52) U.S. Cl.

CPC ..... *F01D 5/3007* (2013.01); *F01D 5/22* (2013.01); *F01D 5/282* (2013.01); *F01D 5/284* (2013.01); *F01D 5/3015* (2013.01); *F01D 5/3084* (2013.01); *F01D 5/3092* (2013.01); *F05D 2300/6033* (2013.01); *Y10S 416/50* (2013.01)

USPC ..... 416/193 R; 416/500

(58) Field of Classification Search

CPC ..... F01D 5/284; F01D 5/282; F01D 5/16; F01D 5/22; F01D 5/30; F01D 5/3007; F01D 5/3023; F01D 5/3084; F01D 11/008

USPC ..... 416/500, 221, 219 R, 140, 190, 248, 416/193 R, 193 A

See application file for complete search history.

(56) References Cited

U.S. PATENT DOCUMENTS

| | | | | |
|---|---|---|---|---|
| 980,480 | A | 1/1911 | Bishop | |
| 3,001,760 | A * | 9/1961 | Guernsey et al. | 416/221 |
| 3,037,741 | A * | 6/1962 | Tuft | 416/221 |
| 3,266,771 | A * | 8/1966 | Walton | 416/190 |
| 3,294,364 | A * | 12/1966 | Stanley | 416/219 R |
| 3,761,200 | A * | 9/1973 | Gardiner | 416/220 R |
| 4,281,967 | A | 8/1981 | Mouille et al. | |
| 4,655,687 | A * | 4/1987 | Atkinson | 416/193 A |
| 5,143,517 | A * | 9/1992 | Vermont | 416/190 |
| 5,284,421 | A | 2/1994 | Chlus et al. | |
| 6,217,283 | B1 * | 4/2001 | Ravenhall et al. | 416/2 |
| 7,374,400 | B2 * | 5/2008 | Boswell | 416/97 R |
| 7,510,379 | B2 * | 3/2009 | Marusko et al. | 416/230 |
| 7,556,477 | B2 | 7/2009 | Sherlock et al. | |
| 2006/0141257 | A1 | 6/2006 | Subramanian et al. | |
| 2009/0269203 | A1 * | 10/2009 | Care et al. | 416/221 |
| 2009/0317612 | A1 | 12/2009 | Subramanian et al. | |

FOREIGN PATENT DOCUMENTS

| | | | |
|---|---|---|---|
| EP | 2372094 | A2 * | 10/2011 |
| GB | 2112466 | A * | 7/1983 |

OTHER PUBLICATIONS

Search Report and Written Opinion from EP Application No. 12176536.6 dated Oct. 2, 2012.

* cited by examiner

*Primary Examiner* — Edward Landrum
*Assistant Examiner* — Joshua R Beebe
(74) *Attorney, Agent, or Firm* — Sutherland Asbill & Brennan LLP

(57) ABSTRACT

The present application provides a compressive stress system for a gas turbine engine. The compressive stress system may include a first bucket attached to a rotor, a second bucket attached to the rotor, the first and the second buckets defining a shank pocket therebetween, and a compressive stress spring positioned within the shank pocket.

14 Claims, 2 Drawing Sheets

COMPRESSIVE STRESS SYSTEM FOR A GAS TURBINE ENGINE

FEDERAL RESEARCH STATEMENT

This invention was made with Government support under Contract No. DE-FC26-05NT42643, awarded by the U.S. Department of Energy (DOE). The Government has certain rights in this invention.

TECHNICAL FIELD

The present application and the resultant patent relate generally to gas turbine engines and more particularly relate to systems and methods for imparting compressive stress to composite airfoils so as to minimize interlaminar tensile stress about the shanks thereof.

BACKGROUND OF THE INVENTION

Airfoils used in gas turbine engines generally have been made from high temperature superalloys given the high temperature operating environment and the various stresses created during operation. Various types of composite materials also have been used given the lightweight nature and the high temperature capabilities of such composite materials. One drawback with such composite materials, however, includes relatively poor interlaminar properties. Moreover, the overall turbine bucket generally may be subject to nonuniform stress patterns under normal operating conditions. As such, the bucket may experience varying degrees of localized stress at different times and at different locations. Turbine buckets therefore may be designed with more composite material at locations such as the shank and the minimum neck areas so as to accommodate high localized tensile stresses.

There is thus a desire for an improved composite materials turbine bucket design. Preferably such an improved turbine bucket design should accommodate increased interlaminar stresses with the use of less material. Such reduced stresses should increase component life while reducing the amount of material also should result in reduced component costs.

SUMMARY OF THE INVENTION

The present application and the resultant patent provide a compressive stress system for a gas turbine engine. The compressive stress system may include a first bucket attached to a rotor, a second bucket attached to the rotor, the first and the second buckets defining a shank pocket therebetween, and a compressive stress spring positioned within the shank pocket. The compressive stress spring asserts a force on the buckets so as to reduce the interlaminar stresses therein.

The present application and the resultant patent further provide a method of reducing interlaminar stresses in a composite material bucket. The method may include the steps of positioning a compressive stress spring in a shank pocket between adjacent buckets, releasing a pair of arms of the compressive stress spring into contact with each of the adjacent buckets, and asserting a compressive force on each of the adjacent buckets by the pair of arms so as to reduce the interlaminar stresses in each of the adjacent buckets.

The present application and the resultant patent further provide a compressive stress system for a gas turbine engine. The compressive stress system may include a first bucket and a second bucket attached to the rotor. The first bucket and the second bucket may include a composite material and may define a shank pocket therebetween. A compressive stress spring may be positioned within the shank pocket so as to assert a force on the first bucket and the second bucket.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
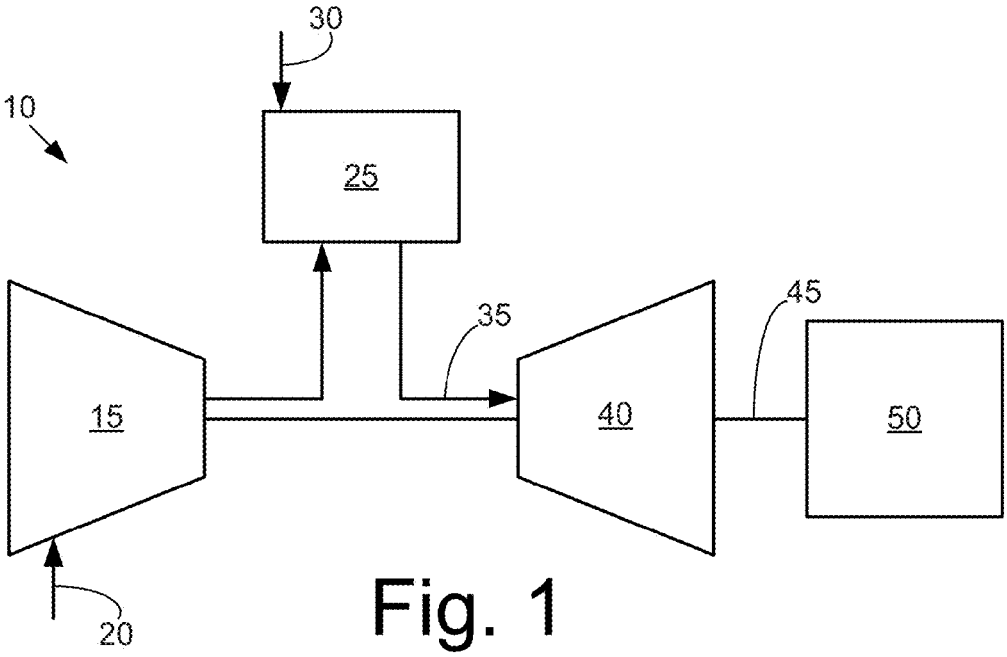
FIG. 1 is a schematic view of a gas turbine engine with a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, various types of syngas, and/or other types of fuels. The gas turbine engine 10 may be any one of a number of different gas turbine engines offered by General Electric Company of Schenectady, N.Y. including, but not limited to, those such as a 7 or a 9 series heavy duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
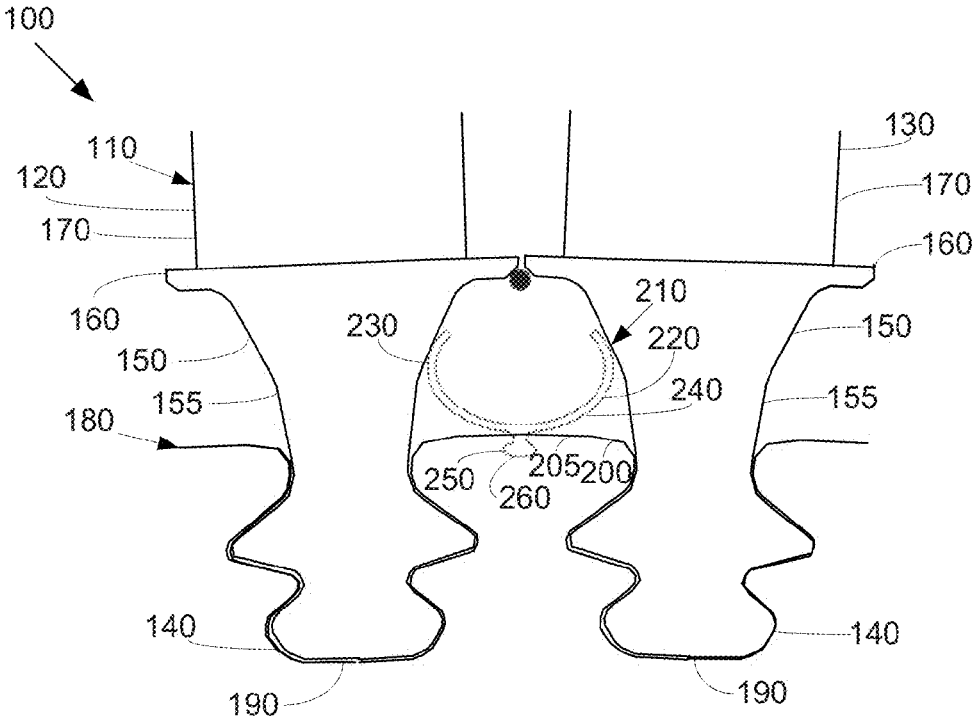
FIG. 2 is a side plan view of a compressive stress system for a turbine bucket as may be described herein showing a compressive stress spring positioned between adjacent buckets.

FIG. 2 shows an example of a turbine bucket compressive stress system 100 as may be described herein. The turbine bucket compressive stress system 100 includes a number of turbine buckets 110. Although the turbine bucket compressive stress system 100 herein will be described in the context of a first turbine bucket 120 and a second turbine bucket 130, any number of turbine buckets 110 may be used herein. The turbine buckets 110 may be made out of a composite material. For example, a number of different ceramic matrix composites and the like may be used herein as well as other types of composites.

Generally described and by way of example only, each turbine bucket 110 may include a dovetail 140, a shank 150, and a platform 160. An airfoil 170 may extend from the platform 160. Each turbine bucket 110 may be positioned within a rotor 180 for rotation therewith. The rotor 180 may include a number of rotor slots 190 separated by rotor posts 200. The rotor slots 190 may be sized and shaped to mate with the dovetails 140 of each turbine bucket 110. The shank 150 may extend from a minimum neck width region 155 to the platform 160. A shank pocket 205 may be defined between the shanks 150 of the adjacent turbine buckets 120, 130 and the rotor post 200. Other components and other configurations may be used herein.

The turbine bucket compressive stress system 100 further may include a compressive stress spring 210. The compressive stress spring 210 may be in the form of a substantially U-shaped clip 220 with a first arm 230 and a second arm 240. The compressive stress spring 210 may be made from any high temperature metallic or composite material with sufficient restoring strength. The compressive stress spring 210 may have any desired size, shape, or configuration. The compressive stress spring 210 also may include a spring dovetail 250. The spring dovetail 250 may be positioned within a spring slot 260 on the rotor 180.

In use, the compressive stress spring 210 may be positioned within the shank pocket 205. The arms 230, 240 of the U-shaped clip 220 may be compressed and then placed in contact with the shanks 150 of the adjacent buckets 120, 130 about the minimum neck width region 155 towards the platform 160. When released, the arms 230, 240 of the U-shaped clip 220 impart a force and therefore compressive stress about the shanks 150. This compressive stress helps to minimize the interlaminar tensile stress generally present in this region of the buckets 120, 130. The compressive stress spring 210 may be retained by the rotor 180 via the spring dovetail 250 so as to minimize any radial load increase on the buckets 120, 130.

The force of the arms 230, 240 returning to their non-deformed shape thus contacts the shanks 150 so as to impart this compressive force. This force generates compressive stress that counteracts the interlaminar tensile stress therein. High interlaminar tensile stress about the shank 150 and the minimum neck region 150 generally dictate how thick the shank 150 must be in order to carry the load of the airfoil 170. The interlaminar tensile stress also impact on the overall life span of the component. By reducing the interlaminar tensile stresses in the shank 150 and the minimum neck region 155, a wider range of design choices may be possible. Moreover, less material may used to reduce the overall costs while lower stresses should improve overall component lifetime.

Figure 3:
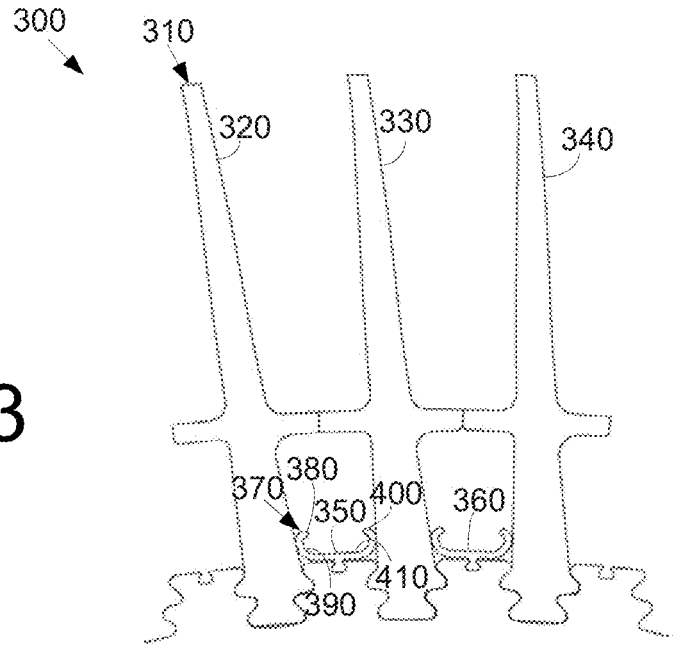
FIG. 3 is a side plan view of an alternative embodiment of a compressive stress system as may be described herein.

FIG. 3 shows a further embodiment of a turbine bucket compressive stress system 300 as may be described herein. In this example, an array 310 of buckets is shown. Specifically, a first bucket 320, a second bucket 330, and a third bucket 340 are shown. Any number of buckets, however, may be used herein. A compressive stress spring may be positioned between each pair of buckets. In this example, a first compressive stress spring 350 and a second compressive string 360 are shown. Any number of compressive stress springs may be used herein. In this example, each compressive stress spring 350, 360 may have a variation of a U-shaped clip 370. In this example, the U-shaped clip 370 also includes a pair of inward curls. Specifically, a first inward curl 380 on a first arm 390 and a second inward curl 400 on a second arm 410. Other variations on the U-shaped clip 370 and the inward curls 380, 400 may be used herein.

Figure 4:
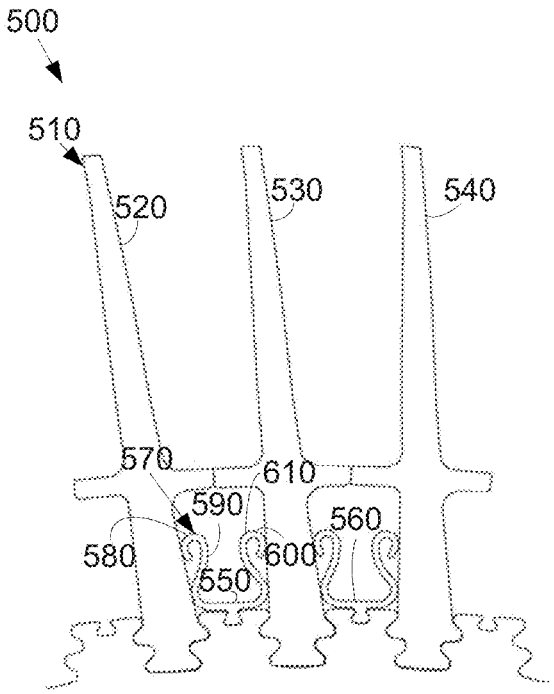
FIG. 4 is a side plan view of an alternative embodiment of a compressive stress system as may be described herein.

FIG. 4 shows a further example of a turbine bucket compressive stress system 500 as may be described herein. The turbine bucket compressive stress system 500 may include an array 510 of buckets. Specifically, a first bucket 520, a second bucket 530, and a third bucket 540 are shown. Any number of buckets may be used herein. Likewise, a compressive stress spring may be positioned between each pair of buckets. In this example, a first compressive stress spring 550 and a second compressive stress spring 560 are shown. Any number of compressive stress springs may be used herein. In this example, the compressive stress springs take the form of a U-shaped clip 570. In this example, the U-shaped clip 570 includes a first outward curl 570 on a first arm 590 and a second outward curl 600 on a second arm 610. Other types of U-shaped clips 570 and the outward curls 580, 600 may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof,

I claim:

1. A compressive stress system for a gas turbine engine, comprising:

a first bucket with a first shank portion and a first platform portion attached to a rotor;

a second bucket with a second shank portion and a second platform portion attached to the rotor;

the first and the second buckets defining a shank pocket therebetween, wherein the shank pocket is defined by the first and the second shank portions and the first and the second platform portions; and a compressive stress spring positioned within the shank pocket, the compressive spring comprising:

a spring dovetail attached to the rotor;

a first arm extending from the spring dovetail towards the first bucket, the first arm in contact only with the first shank portion of the first bucket and comprising a first radially outward curl; and a second arm extending from the spring dovetail towards the second bucket, the second arm in contact only with the second shank portion of the second bucket and comprising a second radially outward curl.

2. The compressive stress system of claim 1, wherein the first and the second shank portions extend from a bucket dovetail to a minimum neck width region to a platform.

3. The compressive stress system of claim 1, wherein the compressive stress spring comprises a U-shaped clip.

4. The compressive stress system of claim 3, wherein the U-shaped clip comprises a first radially inward curl towards the rotor in addition to the first radially outward curl; and a second radially inward curl towards the rotor in addition to the second radially outward curl.

5. The compressive stress system of claim 1, wherein the rotor comprises a rotor post configured to receive the spring dovetail.

6. The compressive stress system of claim 5, wherein the rotor post comprises a spring slot and wherein the spring dovetail mates with the spring slot.

7. The compressive stress system of claim 1, further comprising a plurality of buckets positioned on the rotor in an array and a plurality of compressive stress springs.

8. The compressive stress system of claim 1, wherein the first bucket and the second bucket comprise a composite material.

9. The compressive stress system of claim 8, wherein the composite material comprises a ceramic matrix composite.

10. A method of reducing interlaminar stresses in a composite material bucket, comprising:

positioning a compressive stress spring in a shank pocket between adjacent buckets by engaging a spring dovetail of the compressive spring with a rotor;

releasing a pair of arms of the compressive stress spring into contact only with shank portions of each of the adjacent buckets, the pair of arms comprising radially outward curls; and asserting a compressive force on the shank portions of each of the adjacent buckets by the pair of arms so as to reduce the interlaminar stresses in each of the adjacent buckets.

11. The method of claim 10, further comprising the steps of positioning and releasing a plurality of compressive stress springs.

12. A compressive stress system for a gas turbine engine, comprising:

a first bucket with a first shank portion and a first platform portion attached to a rotor;

a second bucket with a second shank portion and a second platform portion attached to the rotor the first bucket and the second bucket comprise a composite material;

the first bucket and the second bucket define a shank pocket therebetween, wherein the shank pocket is defined by the first and the second shank portions and the first and the second platform portions; and a compressive stress spring with radially outward curls positioned within the shank pocket and asserting a force only on the first shank portion of the first bucket and the second shank portion of the second bucket.

13. The compressive stress system of claim 12, wherein each of the first and the second shank portions extends from a dovetail to a minimum neck width region to the respective first and second platform portions.

14. The compressive stress system of claim 12, wherein the compressive stress spring comprises a U-shaped clip.

* * * * *